US010187729B1

(12) United States Patent
Huang et al.

(10) Patent No.: US 10,187,729 B1
(45) Date of Patent: Jan. 22, 2019

(54) VOICE EMITTING DEVICE OF SPEAKER

(71) Applicants: Hsin-Yi Huang, Taipei (TW); Ching-Hui Huang, Taipei (TW)

(72) Inventors: Hsin-Yi Huang, Taipei (TW); Ching-Hui Huang, Taipei (TW)

( * ) Notice: Subject to any disclaimer, the term of this patent is extended or adjusted under 35 U.S.C. 154(b) by 0 days.

(21) Appl. No.: 15/654,720

(22) Filed: Jul. 20, 2017

(51) Int. Cl.

| | |
|---|---|
| ***H04R 9/06*** | (2006.01) |
| ***H04R 9/02*** | (2006.01) |
| ***H04R 1/28*** | (2006.01) |
| ***H04R 7/20*** | (2006.01) |
| ***H04R 9/04*** | (2006.01) |

(52) U.S. Cl.
CPC ..... *H04R 9/025* (2013.01); *H04R 1/2834* (2013.01); *H04R 1/2873* (2013.01); *H04R 7/20* (2013.01); *H04R 9/045* (2013.01); *H04R 9/06* (2013.01); *H04R 2400/11* (2013.01)

(58) Field of Classification Search
CPC ..... H04R 1/2873; H04R 7/127; H04R 7/18; H04R 7/20; H04R 9/025; H04R 9/04; H04R 9/045; H04R 9/046; H04R 9/06; H04R 2207/021; H04R 2400/11
USPC ..... 381/182, 398, 403, 404, 405, 412, 414, 381/420, 423, 424, 430; 181/157, 164, 181/165, 171
See application file for complete search history.

(56) References Cited

U.S. PATENT DOCUMENTS

| | | | | |
|---|---|---|---|---|
| 4,709,392 A * | 11/1987 | Kato | H04R 7/26 181/157 |
| 5,157,731 A * | 10/1992 | Mitobe | H04R 7/127 381/398 |
| 6,832,106 B2 * | 12/2004 | Sugata | H04R 7/127 381/423 |
| 6,917,690 B2 * | 7/2005 | Stiles | H04R 9/025 381/412 |
| 7,577,270 B2 * | 8/2009 | Horigome | H04R 7/127 381/423 |
| 7,653,209 B2 * | 1/2010 | Abe | H04R 9/025 381/396 |

* cited by examiner

*Primary Examiner* — Huyen D Le

(57) ABSTRACT

A voice emitting device of a speaker is provided. The magnetic vibration element is a larger diameter and thus has a greater driving force. In use, if a greater voice is needed, the structure provided may achieve the effect without operation at full power. Because even the voice emitting device is not worked in full power, the sound quality is good. Furthermore, because the magnetic vibration element of the voice emitting device is larger, a longer impact length is provided. Therefore the response in a low frequency is good and thus the sound quality in lower frequency is not affected.

8 Claims, 5 Drawing Sheets

VOICE EMITTING DEVICE OF SPEAKER

FIELD OF THE INVENTION

The present invention relates to speakers, and in particular to a voice emitting device of a speaker.

BACKGROUND OF THE INVENTION

The main structure of a prior art speaker mainly comprise a vibration membrane which includes a sound diaphragm at an center section thereof, an annular surround edge and an annular supporting sheet. The annular surround edge is combined to an annular outer edge of the sound diaphragm and the annular supporting sheet is combined to an annular outer edge of the annular surround edge. A lower side of the vibration membrane is connected to a voice coil. A coil winds around the voice coil. The voice coil is wound with coils which is electrically conductive. A lower section of the voice coil is surrounded by a magnetic vibration element. A outer radius of the magnetic vibration element is smaller than an outer radius of the sound diaphragm. When the voice coil is conducted, it is interacted with the magnetic vibration element so that the voice coil is interacted with the magnetic vibration element. Therefore the voice coil will push the vibration membrane and thus air vibrates to emit sound. Variation of current to the coil will generate vibrations of different frequencies and thus to have different sound.

However, in the prior art speaker in the prior art, because the outer radius of the magnetic vibration element is smaller than the outer radius of the sound diaphragm, when larger sounds need, the speaker will operate in full power. However, this will induce the distortion of emit sound and moreover, sound quality cannot be retained. Furthermore, in the prior art since the magnetic vibration element in the speaker has a smaller size, the impact distance is short. This is unbeneficial to lower frequency sound to induce the sound quality in low frequency is worse.

Therefore it is desired to have a novel speaker which can improve the above mentioned defects in the prior art.

SUMMARY OF THE INVENTION

Accordingly, the object of the present invention is to provide voice emitting device of a speaker, in that the magnetic vibration element is a larger diameter and thus has a greater driving force. In use, if a greater voice is needed, the structure of the present invention may achieve the effect without operation at full power. Because even the present invention is not worked in full power, the sound quality is good. Furthermore, because the magnetic vibration element of the present invention is larger, a longer impact length is provided. Therefore the response in a low frequency is good and thus the sound quality in lower frequency is not affected.

To achieve above object, the present invention provides a voice emitting device of a speaker, comprising: a vibration membrane being an approximate round thin membrane; the vibration membrane including a sound diaphragm at a center section thereof, an annular surround edge and an annular supporting sheet; the annular surround edge being combined to an annular outer edge of the sound diaphragm, and the annular supporting sheet being combined to an annular outer edge of the annular surround edge; a voice coil arranged below the vibration membrane; the voice coil including a sound cylinder and a coil; the sound cylinder being a hollow round cylinder with an upper edge thereof connected to a combination area of the sound diaphragm and annular surround edge of the vibration membrane; the coil winding around an outer periphery of the sound cylinder being current-conductive. A magnetic vibration element having: an inner annular yoke installed below the vibration membrane, the inner annular yoke being a round cylinder; a lower section of the voice coil surrounding an outer side of an upper section of the inner annular yoke, but not in contact with the inner annular yoke; an outer side of the inner annular yoke expanding outwards as an expansion portion; the inner annular yoke being a magnetic device for magnetic induction; an outer annular yoke arranged below the vibration membrane and surrounding an outer side of the voice coil and not in contact with the voice coil; the outer annular yoke being located above the expansion portion of the inner annular yoke with a gap therebetween; the outer annular yoke being a magnetic device for magnetic induction; an upper surface of the inner annular yoke being higher than that of the outer annular yoke so that the voice coil has a longer impact length and thus has a larger pushing force; therefore the non-linear distortion in low frequency is reduced; a middle annular yoke being located below the outer annular yoke and being around the vibration membrane; the middle annular yoke being arranged between and in contact with the expansion portion of the inner annular yoke and the outer annular yoke so that the inner annular yoke and the outer annular yoke are magnetized; and the vibration membrane, the voice coil and the magnetic vibration element being axial.

A radius from the axial line of the vibration membrane, the voice coil and the magnetic vibration element to an outer side of the outer annular yoke is greater than a radius from the axial line to the combination edge of the annular surround edge and the annular supporting sheet.

BRIEF DESCRIPTION OF THE INVENTION

Figure 1:
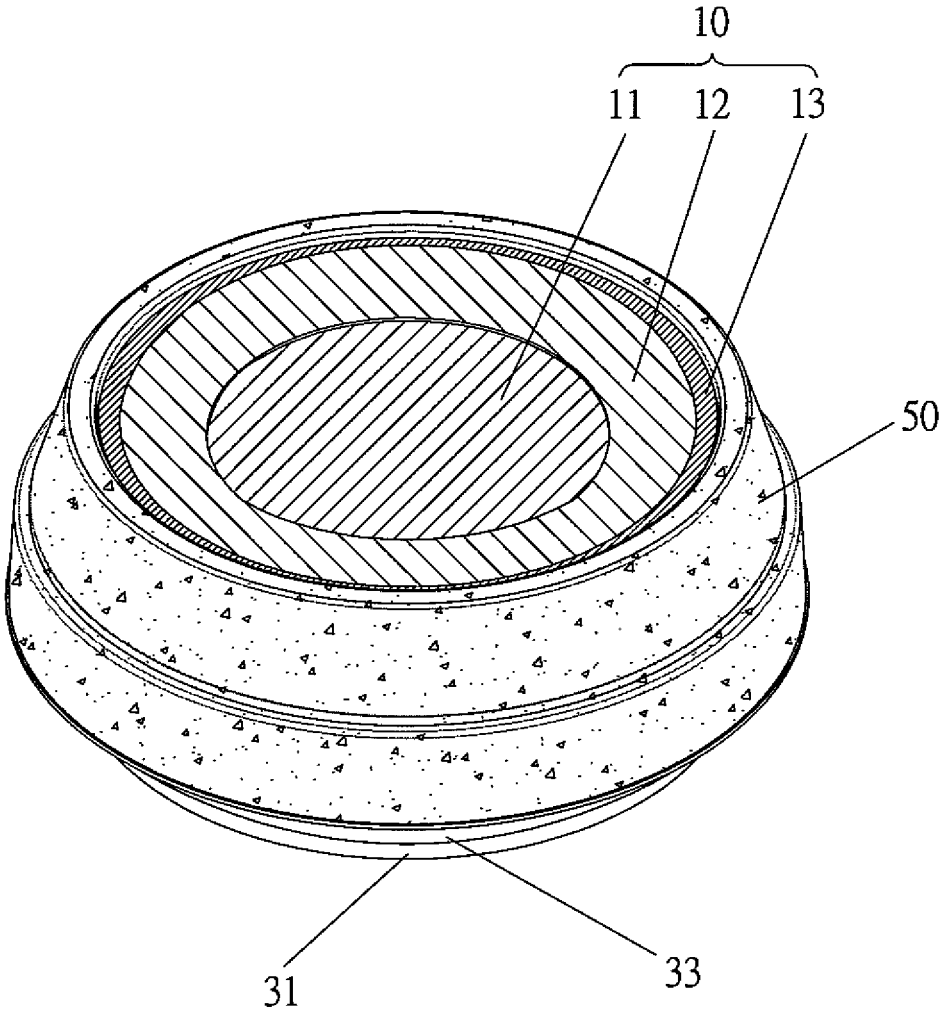
FIG. 1 is an assembly perspective view of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

A vibration membrane 10 is an approximate round thin membrane. As illustrated in FIGS. 1 to 4, the vibration membrane 10 includes a sound diaphragm 11 at a center section thereof, an annular surround edge 12 and an annular supporting sheet 13. The annular surround edge 12 is combined to an annular outer edge of the sound diaphragm 11 and the annular supporting sheet 13 is combined to an annular outer edge of the annular surround edge 12.

A voice coil 20 is arranged below the vibration membrane 10. The voice coil 20 includes a sound cylinder 21 and a coil 22. The sound cylinder 21 is a hollow round cylinder with an upper edge thereof connected to a combination area of the sound diaphragm 11 and annular surround edge 12 of the vibration membrane 10 (referring to FIG. 5). The coil 22 winds around an outer periphery of the sound cylinder 21 (referring to FIG. 3) is current-conductive.

Figure 2:
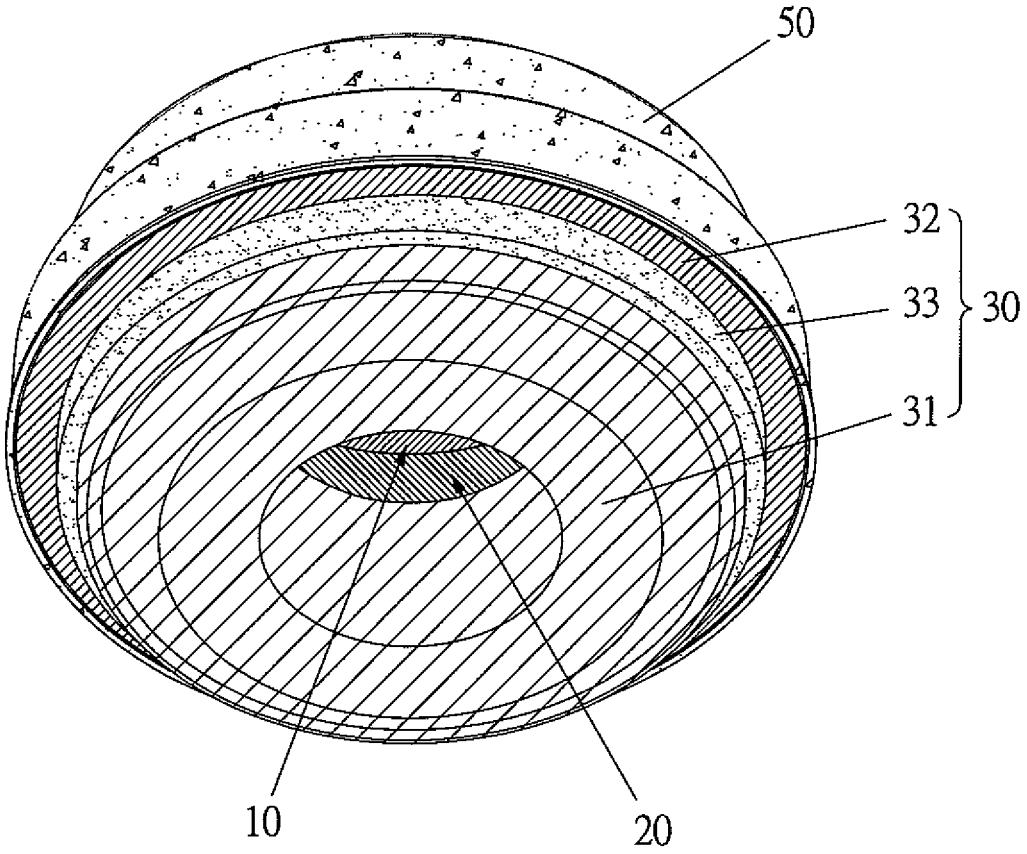
FIG. 2 is a bottom view viewing from the structure illustrated in FIG. 1.
Figure 3:
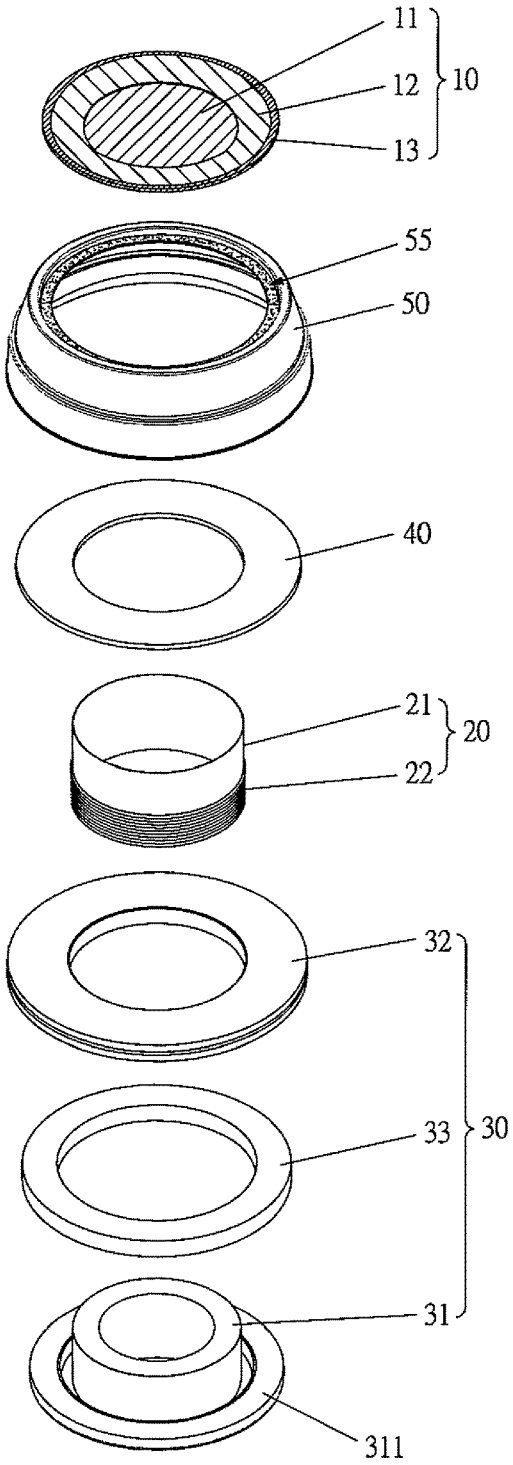
FIG. 3 is an exploded view of the present invention.
Figure 4:
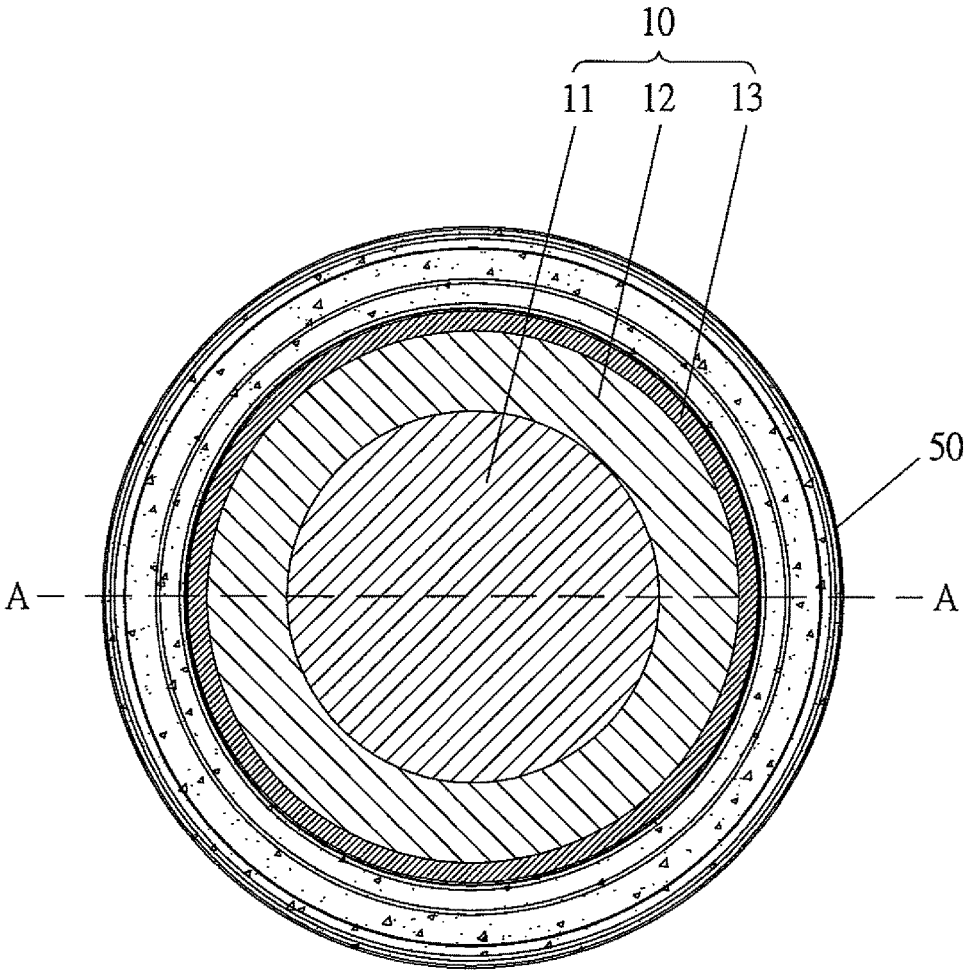
FIG. 4 is a top view of the present invention.
Figure 5:
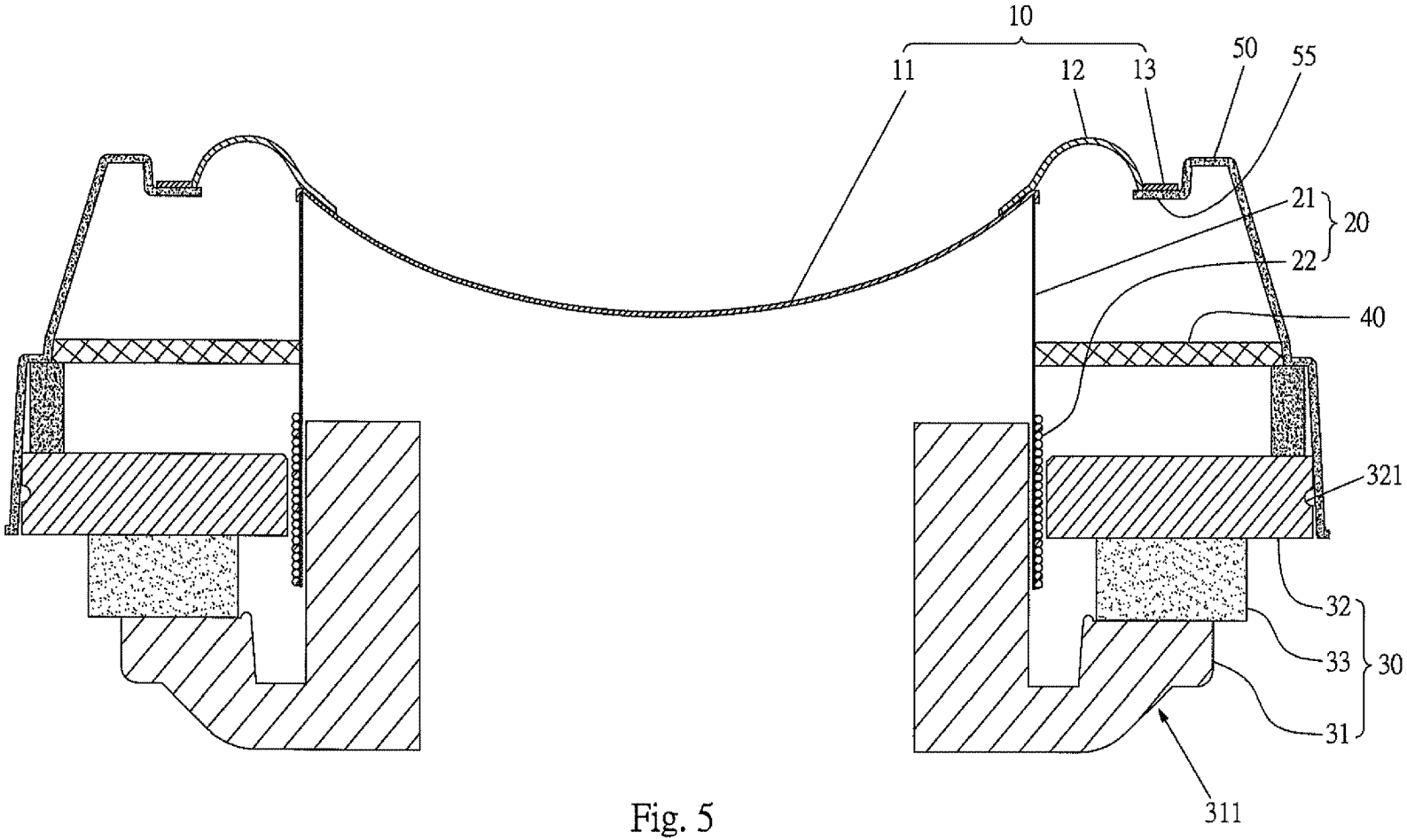
FIG. 5 is a cross sectional view along line A-A of FIG. 4.

A magnetic vibration element 30, as illustrated in FIGS. 2 and 5, comprise:

An inner annular yoke 31 is installed below the vibration membrane 10 and is a round cylinder. A lower section of the voice coil 20 surrounds an outer side of an upper section of the inner annular yoke 31, but not in contact with the inner annular yoke 31. An outer side of the inner annular yoke 31 expands outwards as an expansion portion 311. The inner annular yoke is a magnetic device for magnetic induction. A cross section of the inner annular yoke 31 viewing from an axial direction may be a round shape or a polygonal shape.

An outer annular yoke 32 is arranged below the vibration membrane 10 and surround an outer side of the voice coil 20 and not in contact with the voice coil 20. The outer annular yoke 32 is located above the expansion portion 311 of the inner annular yoke 31 with a gap therebetween. The outer annular yoke 32 is a magnetic device for magnetic induction.

An upper surface of the inner annular yoke 31 is higher than that of the outer annular yoke 32 so that the voice coil 22 has a longer impact length and thus has a larger pushing force. Therefore the non-linear distortion in low frequency is reduced.

A middle annular yoke 33 is located below the outer annular yoke 32 and is around the vibration membrane 10. The middle annular yoke 33 is arranged between and in contact with the expansion portion 311 of the inner annular yoke 31 and the outer annular yoke 32 so that the inner annular yoke 31 and the outer annular yoke 32 are magnetized.

The vibration membrane 10, the voice coil 20 and the magnetic vibration element 30 are axial.

The feature of the present invention is that as illustrated in FIG. 5, a radius from the axial line of the vibration membrane 10, the voice coil 20 and the magnetic vibration element 30 to an outer side of the outer annular yoke 32 is greater than a radius from the axial line to the combination edge of the annular surround edge 12 and the annular supporting sheet 13.

A damper washer 40 is arranged between the vibration membrane 10 and the outer annular yoke 32. The damper washer 40 surrounds an outer side of the voice coil 20. The voice coil 20 is slidably arranged on an inner edge of the damper washer 40. A radial cross section of the damper washer 40 may have different shapes, such as a rectangular shape or a wave like shape An upper cover basin 50 is a hollow structure and arranged at outer side of the vibration membrane 10, the voice coil 20 and the magnetic vibration element 30. A radial inner side of the upper cover basin 50 is extended with an upper supporting ring 55 (referring to FIG. 3). In assembly, as illustrated in FIG. 5, the annular supporting sheet 13 at the outer side of the vibration membrane 10 is fixedly arranged to an upper side of the upper supporting ring 55 so that the annular supporting sheet 13 is difficult to vibrate.

An outer edge of the outer annular yoke 32 may have a notch 321 so that the upper cover basin 50 can be riveted with the outer annular yoke 32.

An axial distance between a highest point of the annular surround edge 12 and a bottom side of the inner annular yoke 31 is smaller than a half of a maximum radius of the upper cover basin 50 so as to have a larger push force to push the voice coil 20 effectively. Thus the structure of the present invention may suffer from a larger power and reduce the distortion in the voice quality.

Furthermore, in the present invention, a maximum inner radius of the voice coil 20 is larger than a half of a maximum outer radius of the upper cover basin 50. A maximum outer radius of the damper washer 40 is approximately equal to an inner radius of the upper cover basin 50 and the maximum outer radius of the damper washer 40 is greater than a maximum outer radius of the annular surround edge 12. Therefore a larger sound pressure is generated and resonance frequency is reduced so that the sound generated is almost equal to the original generated sound and the distortion of resonance in frequency is reduced.

In installation, as illustrated in FIG. 5, an upper edge of the sound cylinder 21 is fixed to the combination area of the annular surround edge 12 of the vibration membrane 10 and the sound diaphragm 11. Therefore the sound diaphragm 11 at the inner side of the vibration membrane 10 is at an upper side of the hollow area of the sound cylinder 21. The annular supporting sheet 13 at the outer side of the vibration membrane 10 is fixedly arranged to an upper side of the upper cover basin 50 so that the annular supporting sheet 13 is difficult to vibrate. Therefore the annular surround edge 12 is arranged between the sound cylinder 21 and the annular supporting sheet 13. A cross section of the sound diaphragm 11 is a concave arc and the annular surround edge 12 is a convex arc.

Advantages of the present invention are that the magnetic vibration element 30 is a larger diameter and thus has a greater driving force. In use, if a greater voice is needed, the structure of the present invention may achieve the effect without operation at full power. Because even the present invention is not worked in full power, the sound quality is good. Furthermore, because the magnetic vibration element of the present invention is larger, a longer impact length is provided. Therefore the response in a low frequency is good and thus the sound quality in lower frequency is not affected.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A voice emitting device of a speaker, comprising:

a vibration membrane being an approximate round thin membrane; the vibration membrane including a sound diaphragm at a center section thereof, an annular surround edge and an annular supporting sheet; the annular surround edge being combined to an annular outer edge of the sound diaphragm, and the annular supporting sheet being combined to an annular outer edge of the annular surround edge;

a voice coil arranged below the vibration membrane; the voice coil including a sound cylinder and a coil; the sound cylinder being a hollow round cylinder with an upper edge thereof connected to a combination area of the sound diaphragm and annular surround edge of the vibration membrane; the coil winding around an outer periphery of the sound cylinder being current-conductive;

a magnetic vibration element having:

an inner annular yoke installed below the vibration membrane, the inner annular yoke being a round cylinder; a lower section of the voice coil surrounding an outer side of an upper section of the inner annular yoke, but not in contact with the inner annular yoke; an outer side of the inner annular yoke expanding outwards as an expansion portion; the inner annular yoke being a magnetic device for magnetic induction;

an outer annular yoke arranged below the vibration membrane and surrounding an outer side of the voice coil and not in contact with the voice coil; the outer annular yoke being located above the expansion portion of the inner annular yoke with a gap therebetween; the outer annular yoke being a magnetic device for magnetic induction;

an upper surface of the inner annular yoke being higher than that of the outer annular yoke so that the voice coil has a longer impact length and thus has a larger pushing force; therefore the non-linear distortion in low frequency is reduced;

a middle annular yoke being located below the outer annular yoke and being around the vibration membrane; the middle annular yoke being arranged between and in contact with the expansion portion of the inner annular yoke and the outer annular yoke so that the inner annular yoke and the outer annular yoke are magnetized; and the vibration membrane, the voice coil and the magnetic vibration element being axial;

wherein, a radius from the axial line of the vibration membrane, the voice coil and the magnetic vibration element to an outer side of the outer annular yoke is greater than a radius from the axial line to the combination edge of the annular surround edge and the annular supporting sheet;

a damper washer arranged between the vibration membrane and the outer annular yoke; the damper washer surrounds an outer side of the voice coil; the voice coil being slidably arranged on an inner edge of the damper washer; and an upper cover basin being a hollow structure and arranged at outer side of the vibration membrane, the voice coil and the magnetic vibration element; a radial inner side of the upper cover basin being extended with an upper supporting ring; in assembly, the annular supporting sheet at the outer side of the vibration membrane is fixedly arranged to an upper side of the upper supporting ring so that the annular supporting sheet is difficult to vibrate.

2. The voice emitting device of a speaker as claimed in claim 1, wherein an outer edge of the outer annular yoke has a notch so that the upper cover basin is riveted with the outer annular yoke.

3. The voice emitting device of a speaker as claimed in claim 2, wherein an axial distance between a highest point of the annular surround edge and a bottom side of the inner annular yoke is smaller than a half of a maximum radius of the upper cover basin so as to have a larger push force to push the voice coil effectively.

4. The voice emitting device of a speaker as claimed in claim 1, wherein a maximum inner radius of the voice coil is larger than a half of a maximum outer radius of the upper cover basin; and a maximum outer radius of the damper washer is approximately equal to an inner radius of the upper cover basin and the maximum outer radius of the damper washer is greater than a maximum outer radius of the annular surround edge.

5. The voice emitting device of a speaker as claimed in claim 4, wherein in installation, an upper edge of the sound cylinder is fixed to the combination area of the annular surround edge of the vibration membrane and the sound diaphragm; and thus the sound diaphragm at the inner side of the vibration membrane is at an upper side of the hollow round cylinder of the sound cylinder; the annular supporting sheet at the outer side of the vibration membrane is fixedly arranged to an upper side of the upper cover basin so that the annular supporting sheet is difficult to vibrate; therefore the annular surround edge is arranged between the sound cylinder and the annular supporting sheet.

6. The voice emitting device of a speaker as claimed in claim 5, wherein a cross section of the sound diaphragm is a concave arc and the annular surround edge is a convex arc.

7. The voice emitting device of a speaker as claimed in claim 6, wherein a cross section of the inner annular yoke viewing from an axial direction is a round shape or a polygonal shape.

8. The voice emitting device of a speaker as claimed in claim 7, wherein a radial cross section of the damper washer has different shapes selected from a rectangular shape or a wave shape.

* * * * *